US006227077B1

(12) United States Patent
Chiang

(10) Patent No.: US 6,227,077 B1
(45) Date of Patent: May 8, 2001

(54) RATCHET MECHANISM FOR TOOL

(76) Inventor: Shu Chi Chiang, No. 33-12, Lane 320, Sec. 1, Sa Tien Road, Da Du Hsiang, Taichung Hsien (TW)

( * ) Notice: Subject to any disclaimer, the term of this patent is extended or adjusted under 35 U.S.C. 154(b) by 0 days.

(21) Appl. No.: 09/346,667

(22) Filed: Jul. 2, 1999

(51) Int. Cl.[7] ..... B25B 13/46
(52) U.S. Cl. ..... 81/63.1; 81/63.2; 81/63
(58) Field of Search ..... 81/60–63.2; 408/120, 408/122, 123

(56) References Cited

U.S. PATENT DOCUMENTS 5,685,204 11/1997 Braun ..... 81/63.1
5,687,820 * 11/1997 Lin .
6,047,802 * 4/2000 Huang .
6,070,503 * 6/2000 Shiao .

* cited by examiner

*Primary Examiner*—Timothy V. Eley
*Assistant Examiner*—Willie Berry, Jr.
(74) *Attorney, Agent, or Firm*—Charles E. Baxley

(57) ABSTRACT

A ratchet tool includes a cartridge secured to a handle and having an orifice for rotatably receiving a gear of a driving stem. The cartridge includes two apertures for slidably receiving two pins. The pins each includes one or more teeth formed in one or both ends and selectively biased to engage with the gear of the driving stem and to control the driving direction of the driving stem. A control ferrule is rotatably engaged on the cartridge and includes an actuator to selectively disengage the teeth of the pins from the gear of the driving stem.

13 Claims, 6 Drawing Sheets

RATCHET MECHANISM FOR TOOL

BACKGROUND OF THE INVENTION

1. Field of the Invention

The present invention relates to a tool, and more particularly to a tool having a ratchet mechanism.

2. Description of the Prior Art

A typical ratchet tool is disclosed in U.S. Pat. No. 5,685,204 to Braun and comprises a gear rotatably received in an insert and a pair of pawls biased to engage with the gear and selectively disengaged from the pawls by a control member. However, an additional control member is required for actuating and disengaging the pawls from the gear. In addition, the pawls may not be stably retained in place.

The present invention has arisen to mitigate and/or obviate the afore-described disadvantages of the conventional ratchet mechanisms for tools.

SUMMARY OF THE INVENTION

The primary objective of the present invention is to provide a ratchet mechanism having a pair of pawls that may be stably retained in place and that may be directly actuated by the control ferrule.

In accordance with one aspect of the invention, there is provided a ratchet tool comprising a handle including a first end, a cartridge including a first end engaged into the first end of the handle and rotated in concert with the handle, the cartridge including an orifice formed therein and including a pair of apertures formed therein and communicating with each other, a driving stem including a first end rotatably received in the orifice of the cartridge and having a gear formed thereon, a pair of pins slidably received in the apertures of the cartridge respectively, means for biasing the tooth of a first end of the ends of the pins to engage with the gear of the driving stem, and means for selectively disengaging the tooth of the pins from the gear of the driving stem to control a driving direction of the driving stem. The ends of the pins each preferably includes one or more teeth formed thereon and the teeth may be changed and selectively biased to engage with the gear of the driving stem when the other teeth are worn out.

The selectively disengaging means includes a control ferrule rotatably engaged on the cartridge, the control ferrule having an inner peripheral portion and having an actuator extended radially inward from the inner peripheral portion of the control ferrule for engaging with the pins and for selectively disengaging the tooth of the pins from the gear of the driving stem to control the driving direction of the driving stem.

The control ferrule includes two depressions formed in the inner peripheral portion thereof for defining the actuator, the depressions of the control ferrule are provided for receiving the pins and for allowing the tooth of the pins to be biased to engage with the gear of the driving stem.

The control ferrule includes three cavities formed in the inner peripheral portion thereof, and the cartridge includes a spring-biased projection selectively engaging with the cavities of the control ferrule to position the control ferrule to the cartridge at a selected angular position.

An annular swelling is further formed on the cartridge, the control ferrule includes an annular flange extended radially inward therefrom and engaged with the annular swelling of the cartridge, and a cap is secured to the cartridge and engaged with the annular flange of the control ferrule for rotatably securing the control ferrule to the cartridge. The cartridge includes an outer peripheral portion having an annular tapered surface formed therein, and the cap includes an inner peripheral portion having an annular tapered surface formed therein and engaged with the tapered surface of the cartridge for limiting an engagement of the cap to the cartridge.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
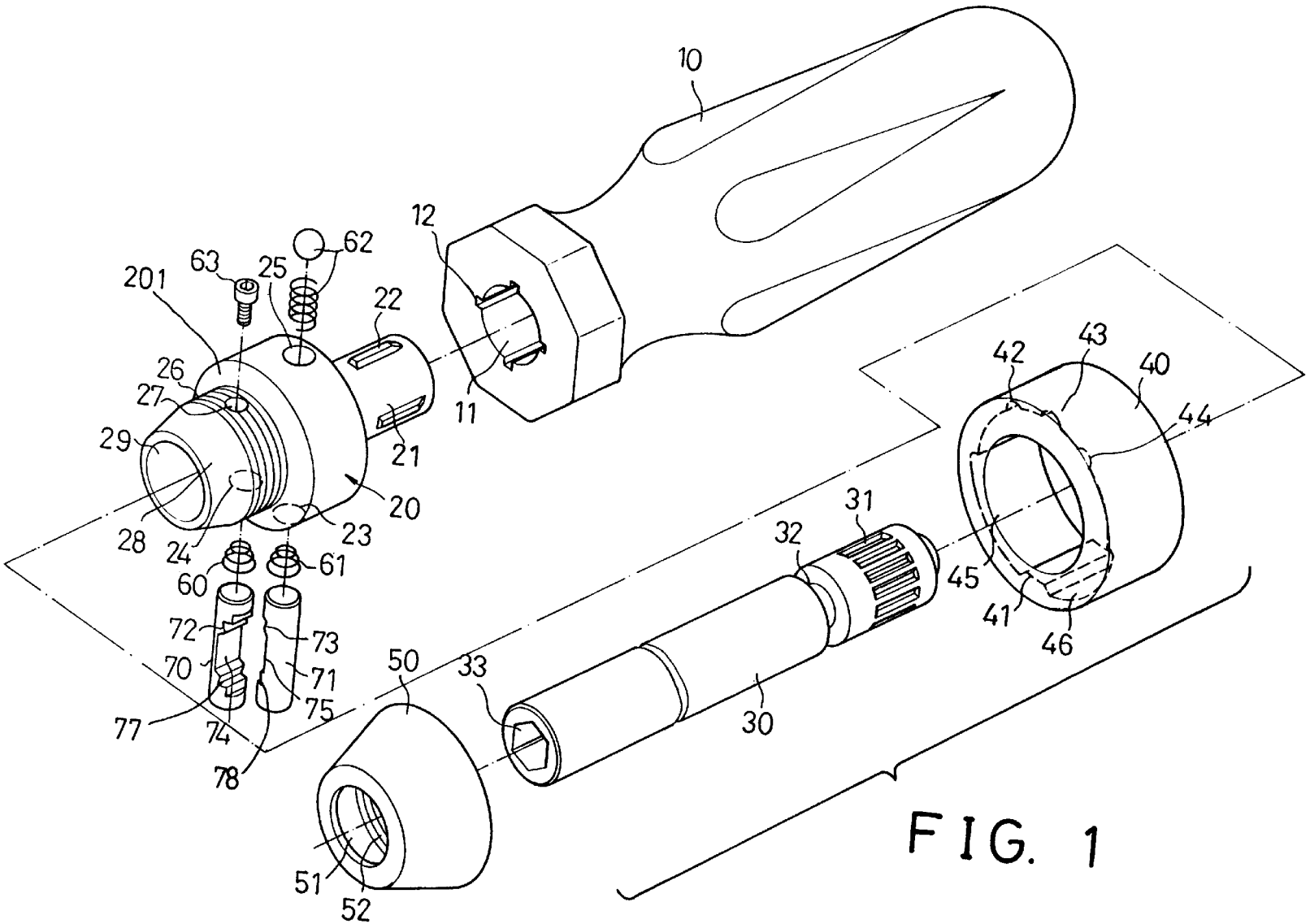
FIG. 1 is an exploded view of a ratchet mechanism for a tool in accordance with the present invention.
Figure 2:
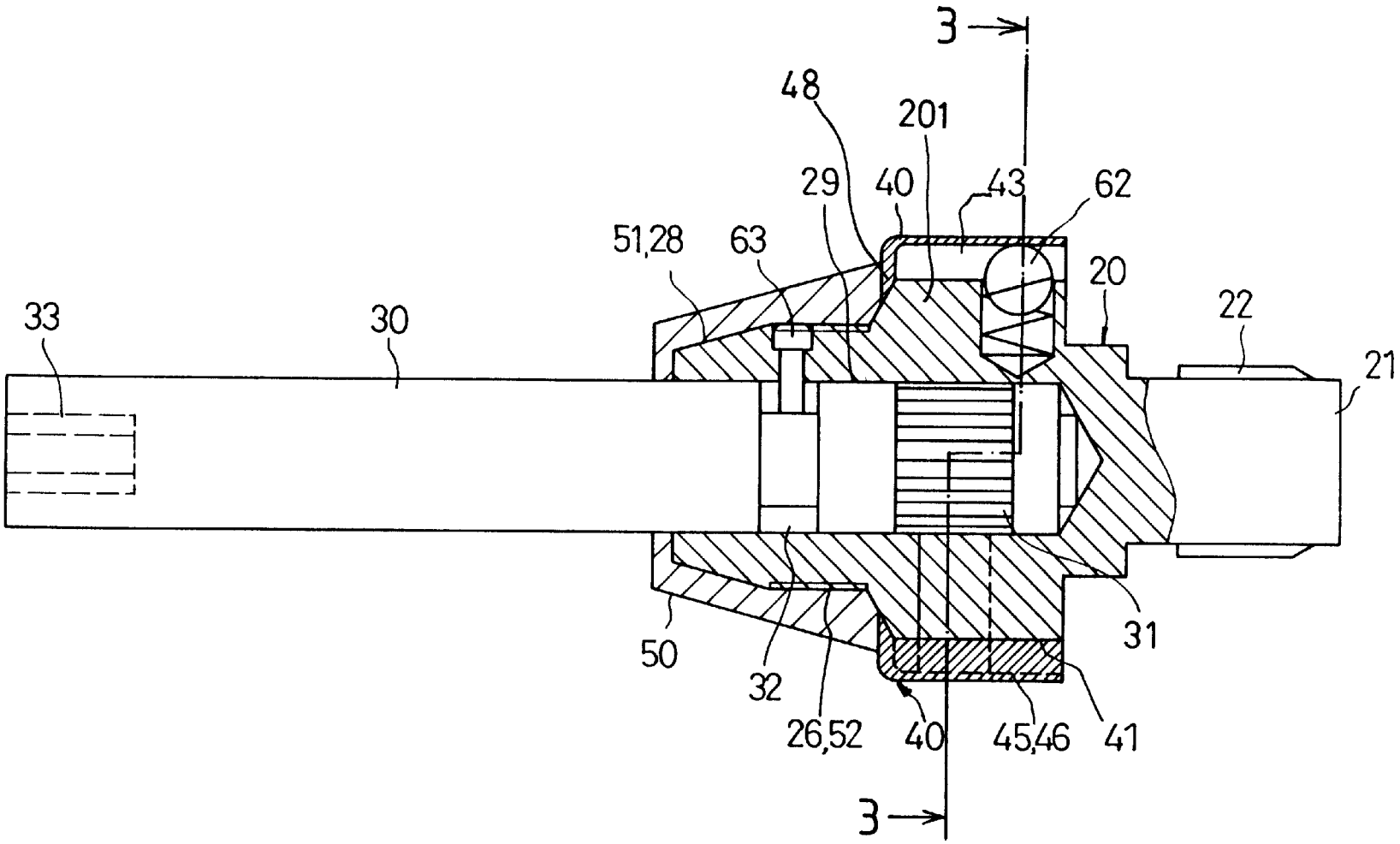
FIG. 2 is a cross sectional view taken along lines 2—2 of FIG. 3.
Figure 3:
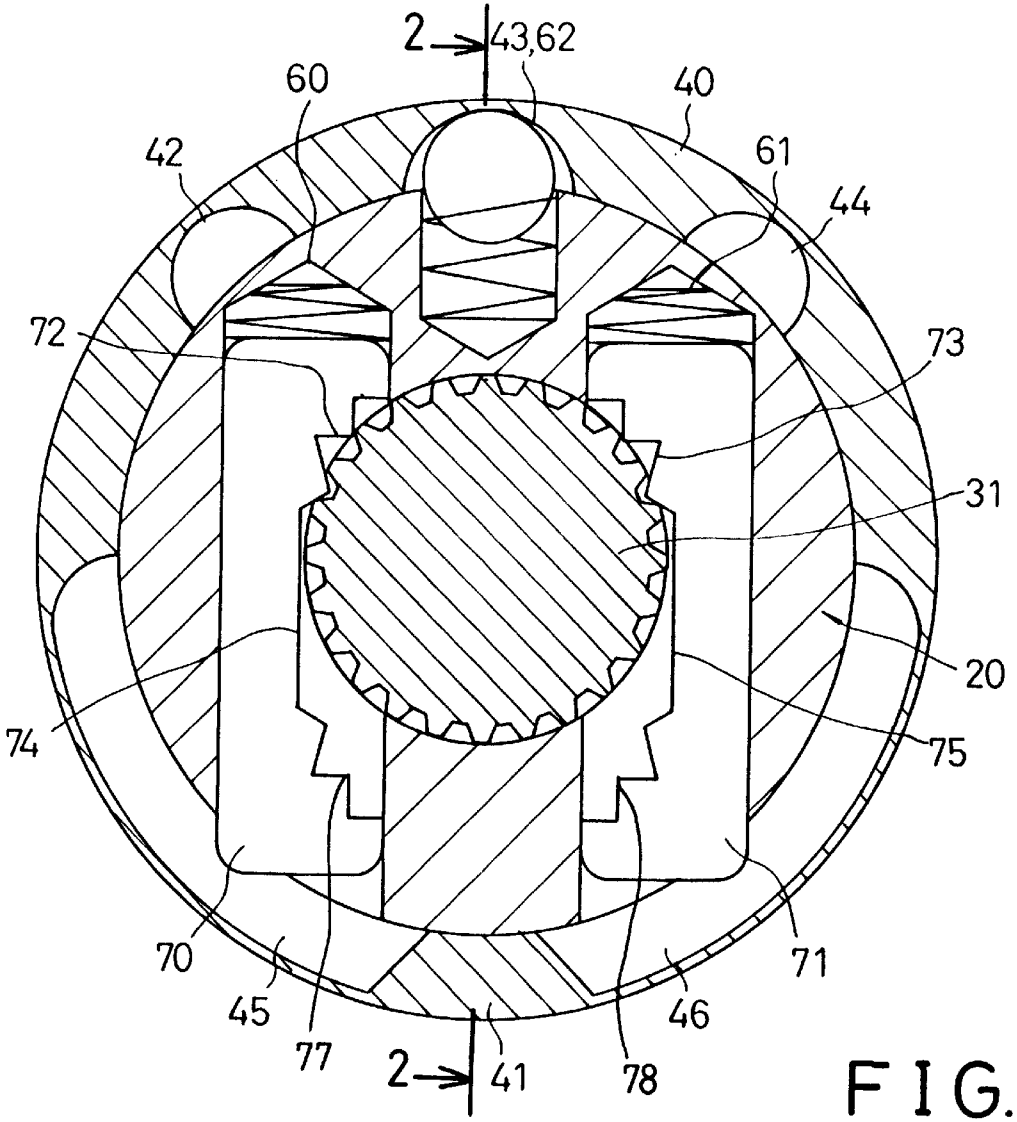
FIG. 3 is a cross sectional view taken along lines 3—3 of FIG. 2.

Referring to the drawings, and initially to FIGS. 1–3, a ratchet mechanism for a tool in accordance with the present invention comprises a handle 10 including a bore 11 and one or more channels 12 formed in one end thereof and communicating with each other. A cartridge 20 includes a stud 21 extended from one end thereof and engaged into the bore 11 of the handle 10 and includes one or more ribs 22 extended from the stud 21 for engaging with the channels 12 of the handle 10 and for securing the cartridge 20 to the handle 10 and for preventing the cartridge 20 from rotating relative to the handle 10.

Figure 4:
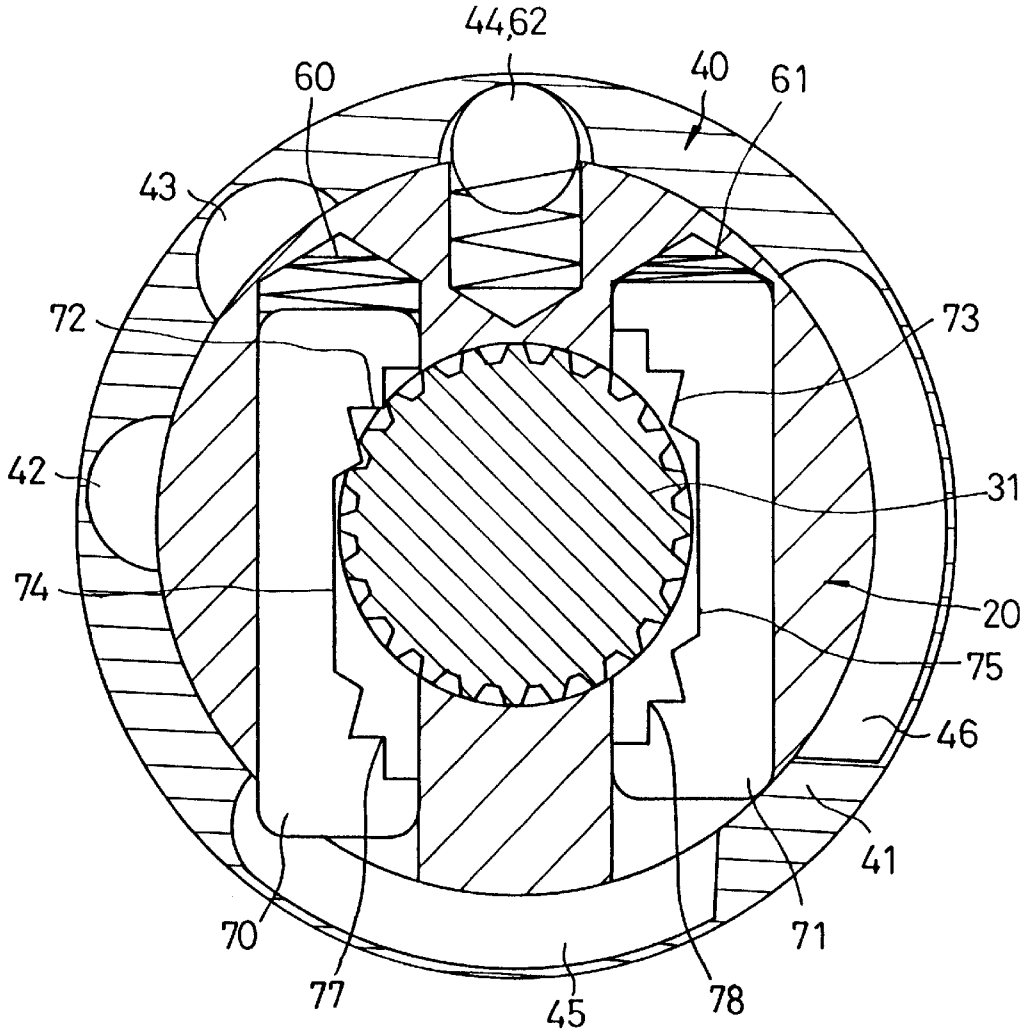
FIG. 4 is a cross sectional view similar to FIG. 3, illustrating the operation of the ratchet mechanism.

The cartridge 20 includes an orifice 29 formed therein for rotatably receiving a driving stem 30 therein, and includes a pair of apertures 23, 24 formed in parallel in the cartridge 20 and communicating with the orifice 29. Two springs 60, 61 and two pins 70, 71 are slidably received in the apertures 23, 24 of the cartridge 20 respectively. The pins 70, 71 each includes a recess 74, 75 formed in the middle portion thereof for receiving the driving stem 30, particularly for receiving the gear 31 of the driving stem 30, and each includes two ends each having one or more teeth 72, 73, 77, 78 formed therein for engaging with the gear 31. The springs 60, 61 may bias the teeth 72, 73 in one end of the pins 70, 71 to engage with the gear 31 (FIGS. 3, 4). When the teeth 72, 73 are worn out, the pins 70, 71 may be changed to different direction for allowing the other teeth 77, 78 to be biased to engage with the gear 31 by the springs 60, 61 respectively. A fastener 63 is engaged through a hole 27 of the cartridge 20 and engaged into an annular groove 32 of the driving stem 30 and for rotatably securing the driving stem 30 to the cartridge 20 and for preventing the gear 31 from being disengaged from the pins 70, 71. The driving stem 30 includes an engaging hole 33 formed in one end for receiving the fasteners, tool extensions or the other tool bits.

A control ferrule 40 is rotatably engaged on the cartridge 20 and particularly engaged on the middle portion of the cartridge 20. The cartridge 20 includes an annular swelling 201 formed in the middle portion thereof and includes a cavity 25 formed in the annular swelling 201 of the cartridge 20 for receiving a spring-biased projection 62. The control ferrule 40 includes an inner peripheral portion having three cavities 42, 43, 44 formed therein for receiving the spring-biased projection 62 and for positioning the control ferrule 40 to the cartridge 20 at the selected angular position. The control ferrule 40 further includes a bulge or an actuator 41 extended radially inward from the inner peripheral portion thereof and preferably defined between two separate depressions 45, 46 for engaging with the pins 70, 71 and for disengaging the teeth 72, 73 of the pins 70, 71 from the gear 31 (FIG. 4). The control ferrule 40 includes an annular flange 48 (FIG. 2) extended radially inward therefrom and engaged with the annular swelling 201 of the cartridge 20.

A cap 50 includes an inner thread 52 threaded with the outer thread 26 of the cartridge 20 for securing the cap 50 to the cartridge 20. The cap 50 is engaged with the control ferrule 40 for rotatably securing the control ferrule 40 to the cartridge 20 and for preventing the control ferrule 40 from being disengaged from the cartridge 20. The cartridge 20 includes an annular tapered surface 28 formed in the outer portion thereof and the cap 50 includes an annular tapered surface 51 formed in the inner peripheral portion thereof and engaged with the tapered surface 28 of the cartridge 20 for limiting the engagement of the cap 50 onto the cartridge 20 and for preventing the cap 50 from over pressing against the control ferrule 40.

In operation, as shown in FIG. 3, when the actuator 41 of the control ferrule 40 is disengaged from the pins 70, 71, the pins 70, 71 are received in the depressions 45, 46 of the control ferrule 40 respectively and the teeth 72, 73 of the pins 70, 71 are biased to engage with the gear 31, such that the gear 31 and thus the driving stem 30 may be driven to rotate in both directions by the handle 10 via the cartridge 20. As shown in FIG. 4, when the control ferrule 40 is rotated in one direction to actuate the actuator 41 thereof to force and to move the pin 71 against the spring 61 and to disengage the teeth 73 of the pin 71 from the gear 31, the gear 31 and thus the driving stem 30 may be driven to rotate in the clockwise direction by the handle 10 via the cartridge 20 and may not be rotated in the counterclockwise direction by the handle 10. When the control ferrule 40 is rotated in the reverse direction to cause the actuator 41 thereof to disengage the teeth 72 of the other pin 70 from the gear 31, the driving stem 30 may be driven to rotate in the counterclockwise direction.

It is to be noted that the pins 70, 71 are stably and slidably retained in the apertures 23, 24 of the cartridge 20 and may be solidly retained in place in the cartridge 20. It is preferable that the apertures 23, 24 of the cartridge 20 and the pins 70, 71 slidably engaged in the apertures 23, 24 of the cartridge 20 include a guiding key-and-groove device; or, the pins 70, 71 and the apertures 23, 24 of the cartridge 20 each includes a non-circular cross section, for guiding the pins 70, 71 to slide along the apertures 23, 24 of the cartridge 20 and for preventing the pins 70, 71 from rotating relative to the cartridge 20. The pins 70, 71 each includes a recess 74, 75 formed in the middle portion thereof for receiving the gear 31 and each includes one or more teeth 77, 78 formed in the other end thereof for engaging with the gear 31 when the teeth 72, 73 of the pins 70, 71 are worn out and when the pins 70, 71 are disposed in the reverse direction. The pins 70, 71 may be directly actuated by the actuator 41 of the control ferrule 40 such that the elements are reduced and the configuration and the cost thereof may be reduced.

Figure 5:
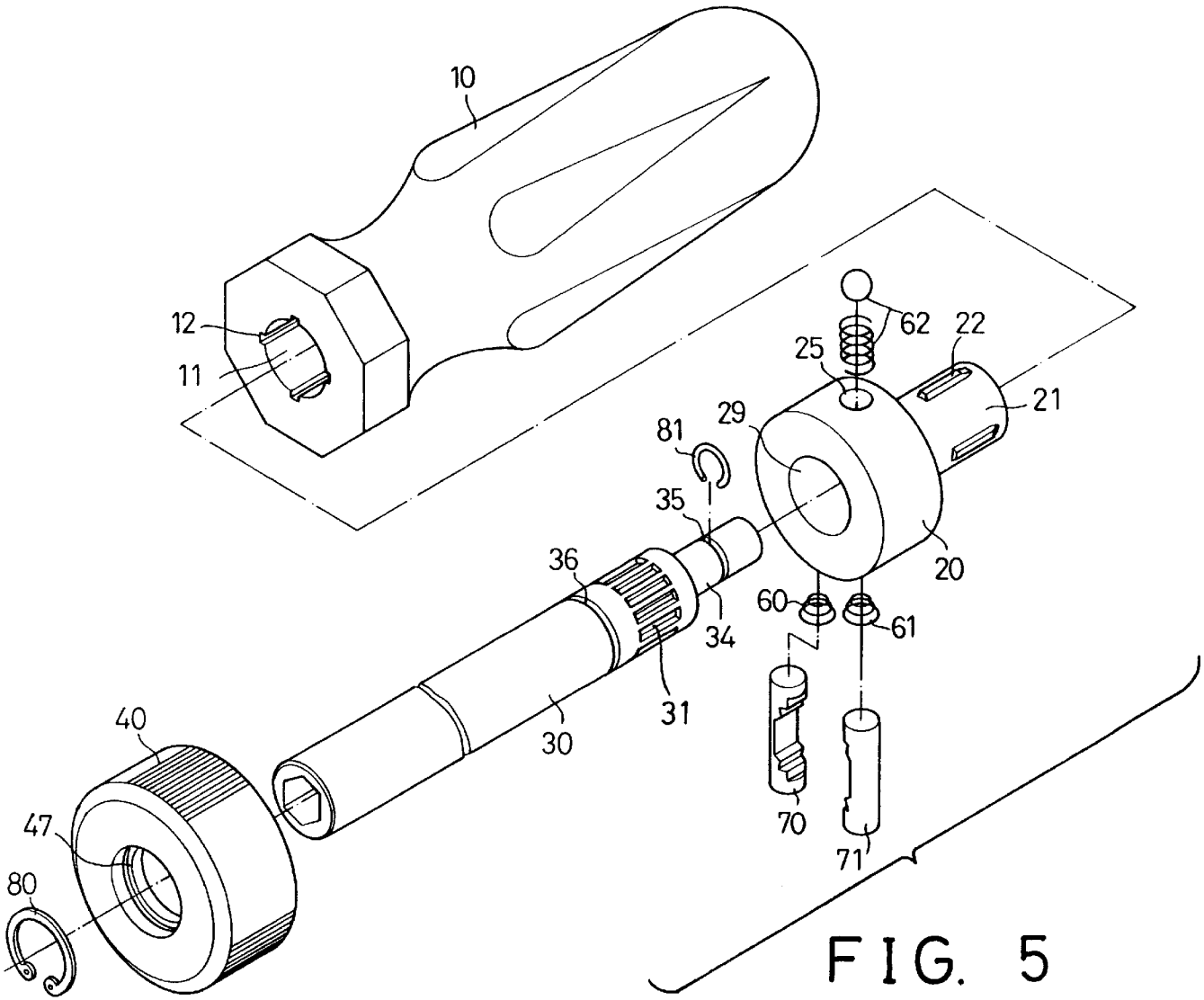
FIG. 5 is an exploded view illustrating the other application of the ratchet mechanism.
Figure 6:
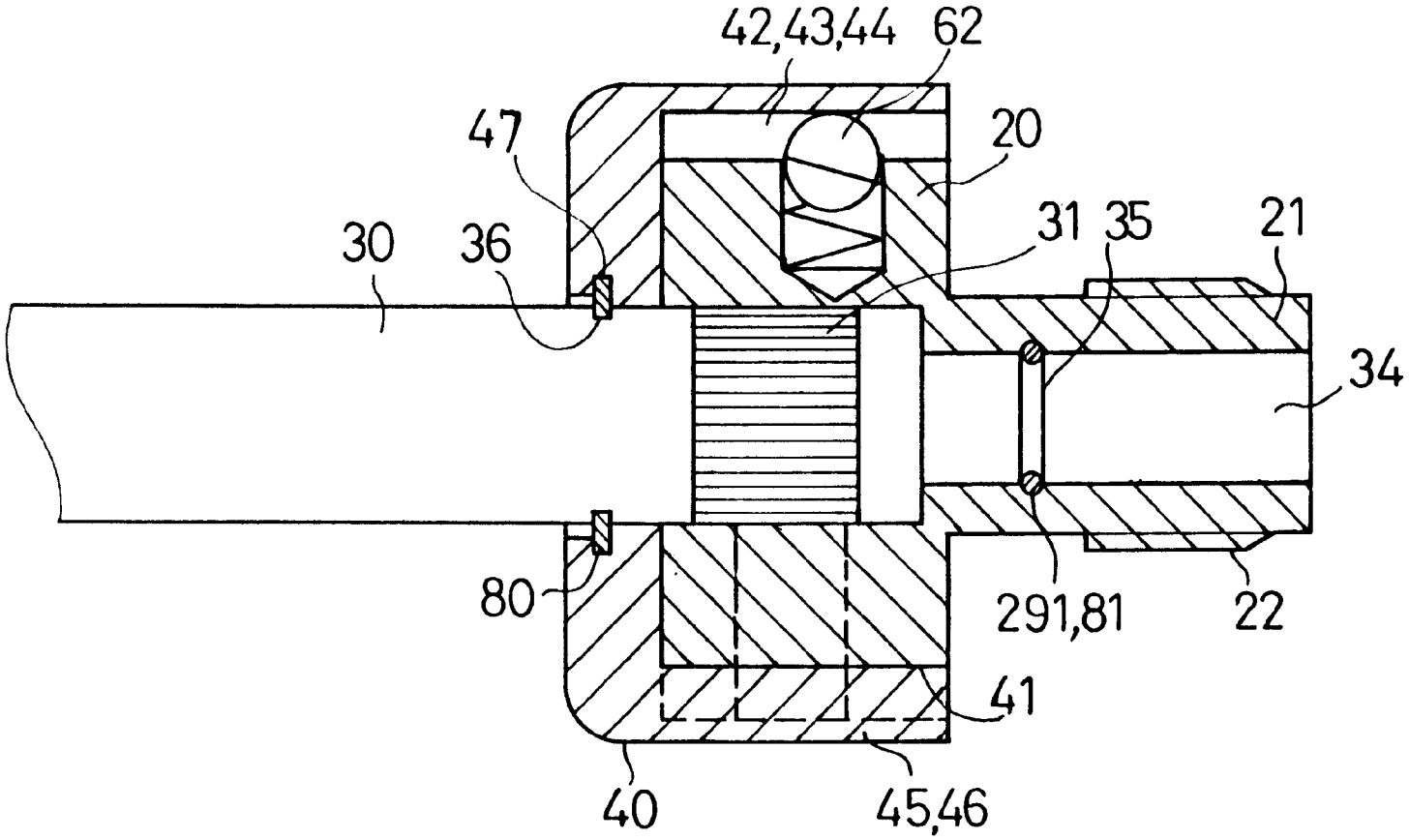
FIG. 6 is a cross sectional view of the ratchet mechanism as shown in FIG. 5.

Referring next to FIGS. 5 and 6, alternatively, the driving stem 30 may includes an extension 34 having an annular slot 35 formed therein for engaging with a retaining ring 81 that is engaged in the annular slot 291 of the cartridge 20, for rotatably securing the driving stem 30 to the cartridge 20. The driving stem 30 may further includes an annular groove 36 formed therein for receiving a retaining ring 80 that is engaged in an annular groove 47 of the control ferrule 40 and for rotatably securing the control ferrule 40 to the driving stem 30.

Accordingly, the ratchet mechanism in accordance with the present invention includes a pair of pawls that may be stably retained in place and that may be directly actuated by the control ferrule.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a handle including a first end, a cartridge including a first end engaged into said first end of said handle and rotated in concert with said handle, said cartridge including an orifice formed therein and including a pair of apertures formed therein and communicating with each other, a driving stem including a first end rotatably received in said orifice of said cartridge and having a gear formed thereon, a pair of pins slidably received in said apertures of said cartridge respectively and each including two ends each having at least one tooth formed thereon, means for biasing said at least one tooth of a first end of said ends of said pins to engage with said gear of said driving stem, and means for selectively disengaging said at least one tooth of said pins from said gear of said driving stem to control a driving direction of said driving stem, said selectively disengaging means including a control ferrule rotatably engaged on said cartridge, said control ferrule including an inner peripheral portion and including an actuator extended radially inward from said inner peripheral portion of said control ferrule for engaging with said pins and for selectively disengaging said at least one tooth of said pins from said gear of said driving stem to control the driving direction of said driving stem, said control ferrule including two depressions formed in said inner peripheral portion thereof for defining said actuator, said depressions of said control ferrule being provided for receiving said pins and for allowing said at least one tooth of said pins to be biased to engage with said gear of said driving stem, said at least one tooth of a second end of said ends of said pins being selectively biased to engage with said gear of said driving stem when said pins are changed to a different position relative to said cartridge.

2. The ratchet tool according to claim 1 further comprising means for rotatably securing said driving stem to said cartridge.

3. The ratchet tool according to claim 1 further comprising means for positioning said control ferrule to said cartridge.

4. The ratchet tool according to claim 1 further comprising means for retaining said control ferrule on said cartridge.

5. The ratchet tool according to claim 1, wherein said pins each includes a middle portion having a recess formed therein for receiving said driving stem.

6. A ratchet tool comprising:

a handle including a first end, a cartridge including a first end engaged into said first end of said handle and rotated in concert with said handle, said cartridge including an orifice formed therein and including a pair of apertures formed therein and communicating with each other, a driving stem including a first end rotatably received in said orifice of said cartridge and having a gear formed thereon, a pair of pins slidably received in said apertures of said cartridge respectively and each including two ends each having at least one tooth formed thereon, means for biasing said at least one tooth of a first end of said ends of said pins to engage with said gear of said driving stem, and means for selectively disengaging said at least one tooth of said pins from said gear of said driving stem to control a driving direction of said driving stem, said at least one tooth of a second end of said ends of said pins being selectively biased to engage with said gear of said driving stem when said pins are changed to a different position relative to said cartridge, means for positioning said control ferrule to said cartridge, said positioning means including three cavities formed in said inner peripheral portion of said control ferrule, and a spring-biased projection received in said cartridge and selectively engaging with said cavities of said control ferrule to position said control ferrule to said cartridge at a selected angular position.

7. A ratchet tool comprising:

a handle including a first end, a cartridge including a first end engaged into said first end of said handle and rotated in concert with said handle, said cartridge including an orifice formed therein and including a pair of apertures formed therein and communicating with each other, a driving stem including a first end rotatably received in said orifice of said cartridge and having a gear formed thereon, a pair of pins slidably received in said apertures of said cartridge respectively and each including two ends each having at least one tooth formed thereon, means for biasing said at least one tooth of a first end of said ends of said pins to engage with said gear of said driving stem, and means for selectively disengaging said at least one tooth of said pins from said gear of said driving stem to control a driving direction of said driving stem, said at least one tooth of a second end of said ends of said pins being selectively biased to engage with said gear of said driving stem when said pins are changed to a different position relative to said cartridge, means for retaining said control ferrule on said cartridge, said retaining means including an annular swelling formed on said cartridge, said control ferrule including an annular flange extended radially inward therefrom and engaged with said annular swelling of said cartridge, and a cap secured to said cartridge and engaged with said annular flange of said control ferrule for rotatably securing said control ferrule to said cartridge.

8. The ratchet tool according to claim 7, wherein said cartridge includes an outer peripheral portion having an annular tapered surface formed therein, and said cap includes an inner peripheral portion having an annular tapered surface formed therein and engaged with said tapered surface of said cartridge for limiting an engagement of said cap to said cartridge.

9. A ratchet tool comprising:

a handle including a first end, a cartridge including a first end engaged into said first end of said handle and rotated in concert with said handle, said cartridge including an orifice formed therein and including a pair of apertures formed therein and communicating with each other, a driving stem including a first end rotatably received in said orifice of said cartridge and having a gear formed thereon, a pair of pins slidably received in said apertures of said cartridge respectively and each including at least one tooth formed thereon, means for biasing said at least one tooth of said pins to engage with said gear of said driving stem, and a control ferrule rotatably engaged on said cartridge and including an inner peripheral portion having an actuator extended radially inward from said inner peripheral portion of said control ferrule for engaging with said pins and for selectively disengaging said at least one tooth of said pins from said gear of said driving stem to control the driving direction of said driving stem, said control ferrule including two depressions formed in said inner peripheral portion thereof for defining said actuator, said depressions of said control ferrule being provided for receiving said pins and for allowing said at least one tooth of said pins to be biased to engage with said rear of said driving stem.

10. The ratchet tool according to claim 9 further comprising means for positioning said control ferrule to said cartridge.

11. The ratchet tool according to claim 10, wherein said positioning means includes three cavities formed in said inner peripheral portion of said control ferrule, and a spring-biased projection received in said cartridge and selectively engaging with said cavities of said control ferrule to position said control ferrule to said cartridge at a selected angular position.

12. The ratchet tool according to claim 9 further comprising means for retaining said control ferrule on said cartridge.

13. The ratchet tool according to claim 12, wherein said retaining means includes an annular swelling formed on said cartridge, said control ferrule including an annular flange extended radially inward therefrom and engaged with said annular swelling of said cartridge, and a cap secured to said cartridge and engaged with said annular flange of said control ferrule for rotatably securing said control ferrule to said cartridge.

* * * * *